US011067376B1

(12) United States Patent
Blazek et al.

(10) Patent No.: US 11,067,376 B1
(45) Date of Patent: Jul. 20, 2021

(54) DIRECT IMPINGEMENT COOK-OFF MECHANISM AND SYSTEM

(71) Applicant: The United States of America, as represented by the Secretary of the Navy, Arlington, VA (US)

(72) Inventors: Benjamin M. Blazek, Ridgecrest, CA (US); Lee R. Hardt, Ridgecrest, CA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 127 days.

(21) Appl. No.: 16/390,328

(22) Filed: Apr. 22, 2019

(51) Int. Cl.

| | |
|---|---|
| ***F42B 39/14*** | (2006.01) |
| ***F42B 39/20*** | (2006.01) |
| ***F42C 19/02*** | (2006.01) |
| ***F42B 12/20*** | (2006.01) |

(52) U.S. Cl.
CPC ..... *F42B 39/20* (2013.01); *F42B 12/207* (2013.01); *F42B 39/14* (2013.01); *F42C 19/02* (2013.01)

(58) Field of Classification Search
CPC ..... F42B 12/207; F42B 39/14; F42B 39/20; F42C 19/02; F42C 19/083; F42C 19/00; F42C 19/0807
USPC ..... 102/481
See application file for complete search history.

(56) References Cited

U.S. PATENT DOCUMENTS

| | | | | | |
|---|---|---|---|---|---|
| 4,004,516 | A * | 1/1977 | Johnson | F42B 39/00 | 102/499 |
| 4,411,199 | A * | 10/1983 | Yates | F42C 19/0838 | 102/202.1 |
| 4,991,513 | A * | 2/1991 | Malamas | F42B 39/20 | 102/293 |
| 5,035,181 | A * | 7/1991 | Jacks | F42C 19/02 | 102/481 |
| 5,939,662 | A * | 8/1999 | Bootes | F42B 12/06 | 102/473 |
| 6,227,119 | B1 * | 5/2001 | Schmacker | F42B 25/00 | 102/473 |
| 6,523,477 | B1 * | 2/2003 | Brooks | F42B 30/003 | 102/481 |
| 7,353,755 | B2 * | 4/2008 | Aumasson | F42B 39/20 | 102/481 |
| 8,234,979 | B1 * | 8/2012 | Falabella | F42C 11/00 | 102/499 |
| 10,408,593 | B1 * | 9/2019 | Blazek | F42B 39/20 | |
| 10,408,594 | B1 * | 9/2019 | Blazek | F42B 39/14 | |
| 10,634,474 | B1 * | 4/2020 | Blazek | F42B 39/20 | |
| 10,890,425 | B1 * | 1/2021 | Blazek | F42B 39/20 | |

* cited by examiner

*Primary Examiner* — James S Bergin
(74) *Attorney, Agent, or Firm* — Naval Air Warfare Center Weapons Division; James M. Saunders

(57) ABSTRACT

Embodiments are directed to direct impingement cook-off mitigation systems. As assembled, a munition fuzewell is torqued into the aft end of a munition. During a cook-off event, the expanding gases from the booster energetic will burn instead of detonating. The hot expanding booster gases are vented to the munition's main fill energetic causing the main fill energetic to burn concurrently with the booster energetic. The combined expanding gases from both the booster and main fill energetics are then vented through longitudinal vents.

8 Claims, 5 Drawing Sheets

DIRECT IMPINGEMENT COOK-OFF MECHANISM AND SYSTEM

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD

Embodiments generally relate to insensitive munitions and shock mitigation.

Figure 1:
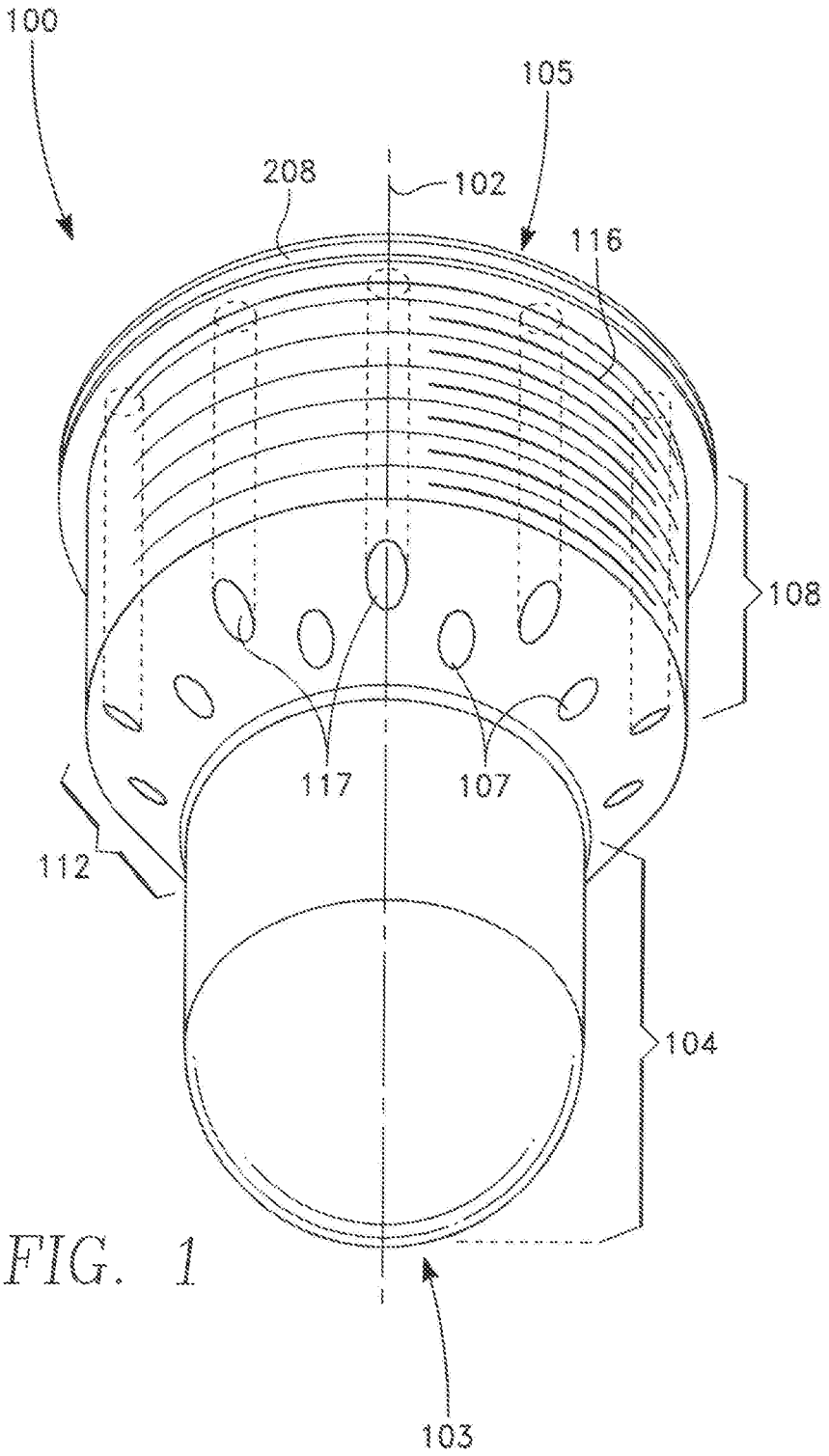
FIG. 1 is a perspective view of a direct impingement cook-off mechanism, according to some embodiments.

It is to be understood that the foregoing general description and the following detailed description are exemplary and explanatory only and are not to be viewed as being restrictive of the embodiments, as claimed. Further advantages will be apparent after a review of the following detailed description of the disclosed embodiments, which are illustrated schematically in the accompanying drawings and in the appended claims.

DETAILED DESCRIPTION OF EMBODIMENTS

Embodiments may be understood more readily by reference in the following detailed description taking in connection with the accompanying figures and examples. It is understood that embodiments are not limited to the specific devices, methods, conditions or parameters described and/or shown herein, and that the terminology used herein is for the purpose of describing particular embodiments by way of example only and is not intended to be limiting of the claimed embodiments. Also, as used in the specification and appended claims, the singular forms "a," "an," and "the" include the plural.

Embodiments generally relate to insensitive munitions (IM) improvements and shock mitigation improvements. Current IM release methods have limited or no secondary vent areas and rely on the increasing pressure and heat of reaction to fail the attachment interface and eject the fuze and or fuzewell. Current IM vent methods rely on additional energetic materials (beyond the booster and main-fill) to control the ignition point and time in the main energetic materials. Embodiments solve this problem by offering additional secondary vent paths having unique geometrical configurations that assist in venting. Embodiments also improve fuze survivability by reducing shocks transmitted to the fuze. Embodiments are also used to restrain smaller diameter parts within a larger diameter shell or case. Current IM technologies incur problems associated with additional energetic materials such as chemical compatibility between the secondary energetic material and the main energetic material, and parasitic mass and volume. Embodiments avoid these by directing the hot decomposition products from the booster to impinge on, and, thus control the ignition point of the main energetic material. The booster is separated from the main energetic thus eliminating chemical compatibility issues and parasitic mass and volume.

Some embodiments are referred to as a direct impingement cook-off mechanism (DICM). The DICM acronym is also used, at times, interchangeably while referring to a direct impingement cook-off mitigation system. The embodiments allow for variable venting of ignited energetics, enabling an improved munition response to Slow Cook-Off (SCO) and Fast Cook-Off (FCO) insensitive munitions tests.

Structural features are also included that reduce the shock experienced by a munition fuze due to, but not limited to, loads during weapon penetration and pyre-shock. Component material and orientation provides damping and impedance mismatches across interfaces. This additional damping, as well as impedance mismatches, results in reduced shock and vibrational pressures and stresses transmitted to munition fuzes. Based on this, embodiments are applicable to penetrating and non-penetrating warhead, bomb, and rocket motor families in which a plug or base is desired to provide variable venting and/or release.

Although embodiments are described in considerable detail, including references to certain versions thereof, other versions are possible such as, for example, orienting and/or attaching components in different fashion. Therefore, the spirit and scope of the appended claims should not be limited to the description of versions included herein.

In the accompanying drawings, like reference numbers indicate like elements. Reference characters 100, 200, 250, 300, and 400 depict various embodiments, sometimes referred to as mechanisms, apparatuses, devices, systems, and similar terminology. Several views are presented to depict some, though not all, of the possible orientations of the embodiments. Some figures depict section views and, in some instances, partial section views for ease of viewing. Section hatching patterning is for illustrative purposes only to aid in viewing and should not be construed as being limiting or directed to a particular material or materials. Components used, along with their respective reference characters, are depicted in the drawings. References made to "munition(s)," and "fuze(s)," are generic and not to any particular component, unless noted otherwise. Components depicted are dimensioned to be close-fitting (unless noted otherwise) and to maintain structural integrity both during storage and while in use, References to components such as screws, adhesives, and the like are made, but the drawings do not specifically show these for ease of viewing.

Insensitive Munitions Embodiments

Referring to FIG. 1, an embodiment includes a fuzewell 100 centered about a central longitudinal axis 102. The central longitudinal axis 102, although depicted in somewhat exaggerated form for ease of viewing, is depicted in all figures to show that it is common to all components and can also be referred to as a common longitudinal axis. The central longitudinal axis 102 is used as a reference feature for orientation.

The fuzewell 100 can be stainless steel, Silicon Aluminum Metal Matrix Composite, and other erodible metals that will erode and provide greater damping properties over steel.

The fuzewell 100 is hollow and can be referred to as a hollow fuzewell, vented fuzewell, vented plug, and other similar terminology without detracting from the merits or generalities of the embodiments. The fuzewell 100 has a proximal end 103, a distal end 105, an inner surface 115 (FIG. 2A), an outer surface 116, a first outer portion 104, and a second outer portion 108. The first and second outer portions 104 & 108 are separated by a flared region 112. The first and second outer portions 104 & 108 have corresponding diameters, sometimes referred to as first and second diameters.

The inner surface 115 and outer surface 116 of the fuzewell 100 define a wall 118. The proximal end 103 of the fuzewell 100 is a semi-ellipsoidal shape. The outer surface 116 is threaded along the second outer portion 108 and, at times, is referred to as the threaded outer surface. A thread relief 208 is shown at the distal end 105.

The first outer portion 104 corresponds to the proximal end 103 and the second outer portion 108 corresponds to the distal end 105. As shown in FIG. 1, the first outer portion's 104 corresponding diameter is smaller than the second outer portion's 108 corresponding diameter. In the embodiments, the flared region 112 transitions from the first outer portion 104 (first diameter) to the second outer portion 108 (second diameter).

Figure 2A:
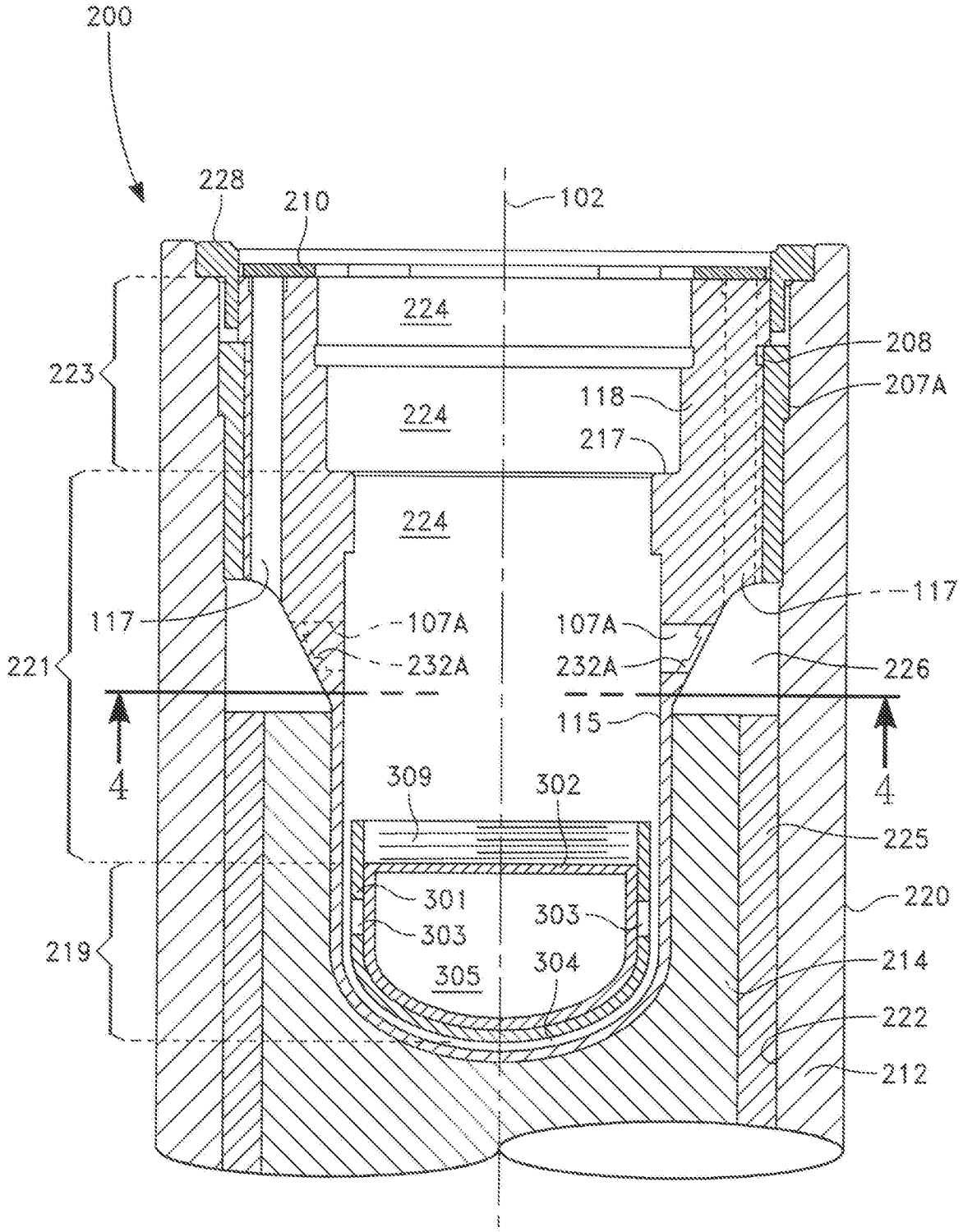
FIG. 2A is a section view of the direct impingement cook-off mechanism shown in FIG. 1 and its orientation environment in the aft end of a generic munition.
Figure 4:
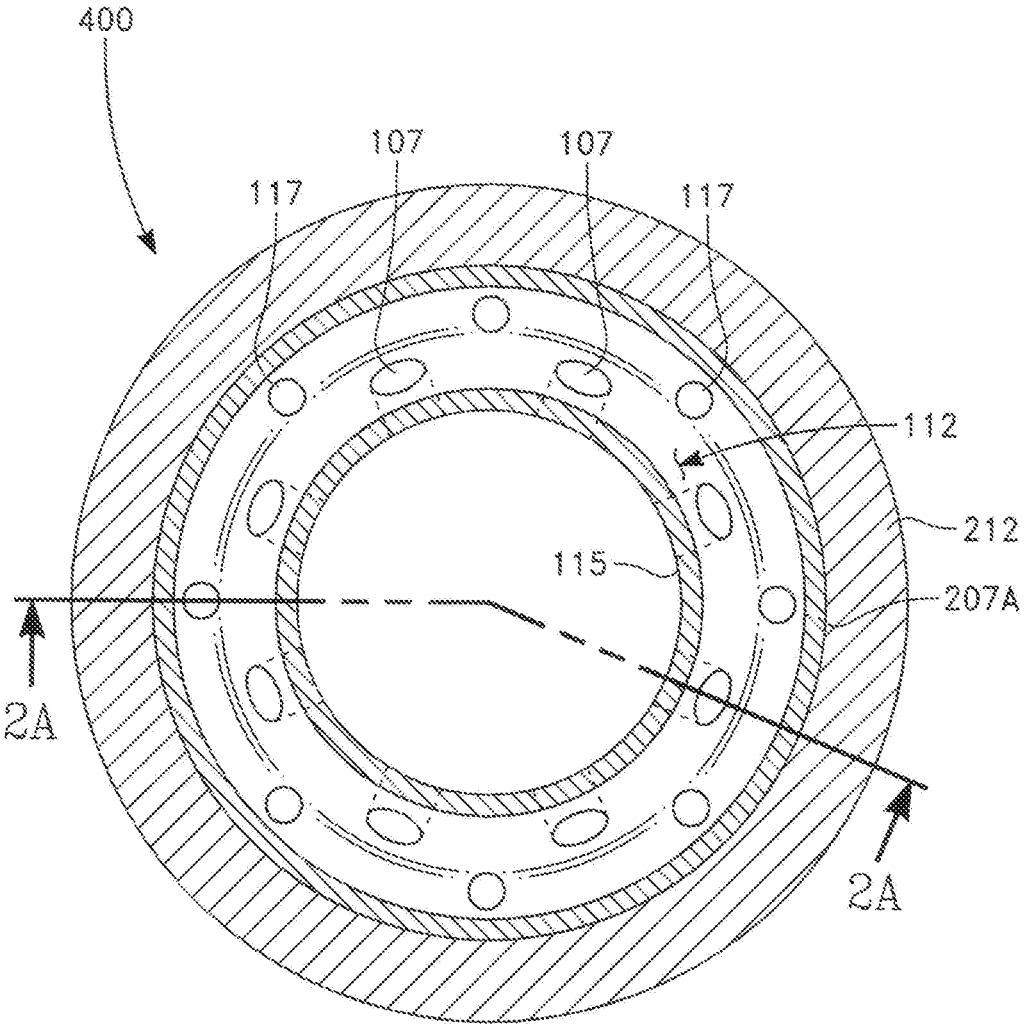
FIG. 4 is a section view of the direct impingement cook-off mechanism shown in FIG. 1, along cut plane 4-4 in FIG. 2A.

The inner surface 115 of the fuzewell 100 defines a fuzewell inner envelope 224. The fuzewell inner envelope 224 has a first inner portion 219, a second inner portion 221, and third inner portion 223. The first inner portion 219 is located at the proximal end 103. The first inner portion 219 transitions to the second inner portion 221 and the second inner portion transitions to the third inner portion 223. The third inner portion 223 is located at the distal end 105. In FIG. 2A, depicted by reference character 200, a section view of the embodiment in FIG. 1 is shown. The cut plane for the section view in FIG. 2A is along the central longitudinal axis 102. The overall symmetry of the embodiments is shown in all figures, including the section view in FIG. 4, and depicted by reference character 400. FIG. 4 depicts the embodiment from FIG. 1, as viewed along cut plane 4-4 in FIG. 2A.

As shown in FIG. 2A, the first, second, and third inner portions 219, 221, & 223 are centered about the central longitudinal axis 102. A booster housing 301 is inside the fuzewell 100 at the proximal end 103. A conduit 304, sometimes referred to as a channel, air gap, or air gap conduit is concentric about the booster housing 301, and separates the booster housing from the inner surface 115 at the proximal end 103. The channel 304 is a conduit for expanding gases during a cook-off event. As shown in FIG. 2A, the positioning of the booster housing 301 corresponds to the first inner portion 219 separated by the air gap 304 to the inner surface 115 of the interior of the fuzewell 100.

Figure 3:
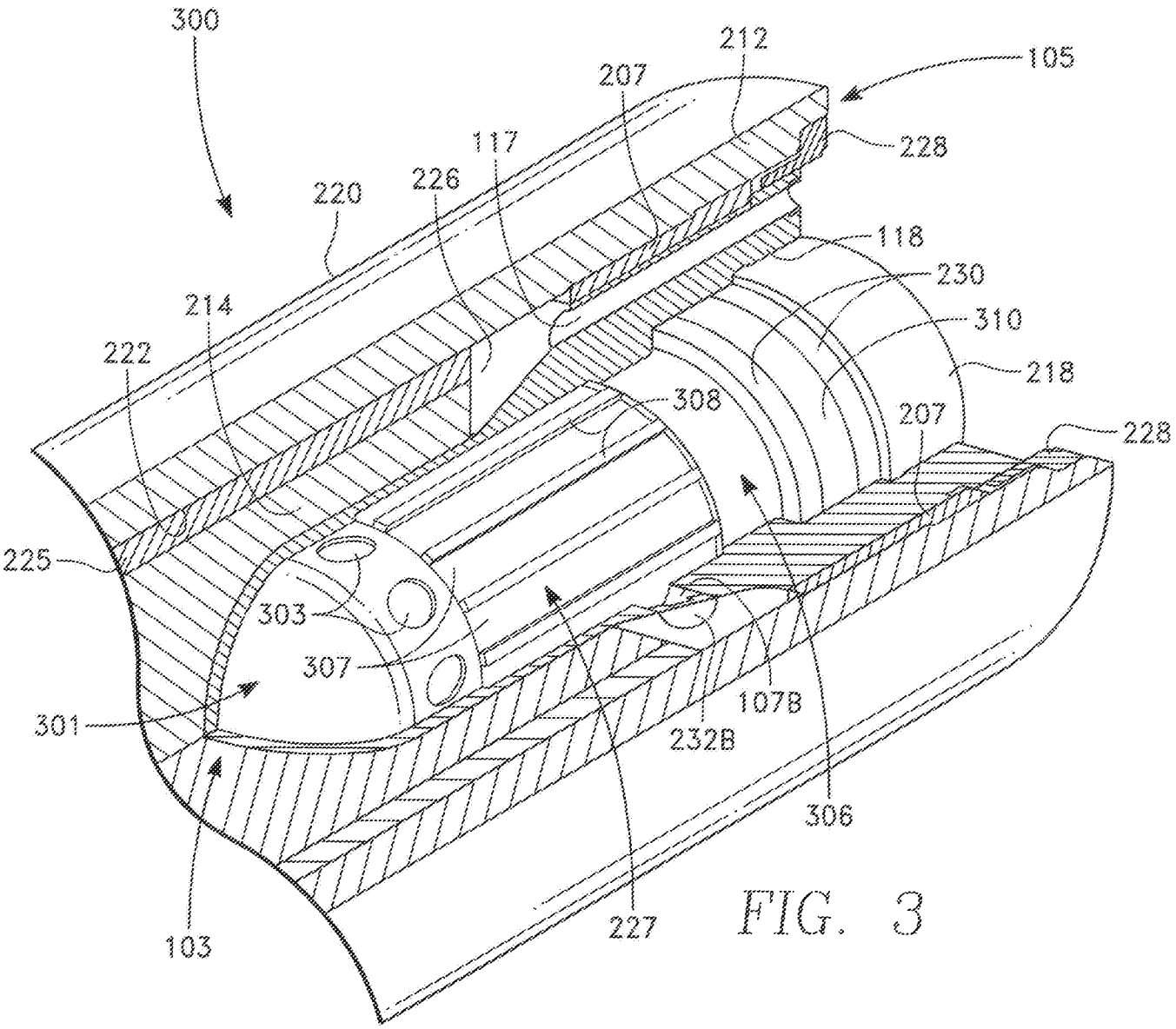
FIG. 3 is a cutaway isometric view of a system employing the disclosed embodiments in the aft end of a generic munition.

The booster housing 301 is a metal sleeve, such as steel or aluminum alloys, for encapsulating booster components. As shown in FIGS. 2A and 3, the booster housing 301 has a plurality of circumferentially-spaced holes 303 penetrating through the booster housing. The booster housing 301 is open on its aft end (the end where the booster housing attaches to a munition fuze 306). Booster housing 301 attachment to the fuze 306 is by threading engagement. The fuze 306 is not shown in FIG. 2A for ease of viewing, but a portion of the fuze is shown in FIG. 3. The threading engagement of the booster housing 301 into the fuze 306 is by a threaded interface 309 at the aft end of the booster housing. The threaded interface 309 is configured to threadingly-engage with the fuze 306.

The fuze 306 is generically shown in the cutaway isometric view (reference 300 in FIG. 3) but not shown in other figures for ease of viewing. The circumferentially-spaced holes 303 are evenly-spaced at equal distance about the perimeter of the booster housing 301 with a range of about three to about twelve holes. The circumferentially-spaced holes 303 are shown in FIG. 3 as being circular, although any shape can be used. The booster housing 301 is concentric about a thermally-softening booster cup 302, which can also be referred to as a thermally-softening booster sleeve, or simply booster cup or booster sleeve. The booster housing 301 and booster cup 302 are bonded together.

Although not specifically shown in FIG. 2A for ease of viewing, a person having ordinary skill in the art will recognize that the booster cup 302 is a two-piece component, with the first piece being the portion adjacent to the booster housing 301 and the second piece being the portion that is closest to the fuze 306. The booster cup 302 is a polymer or reinforced polymer. Reinforcement is provided by embedded glass or carbon fibers which are not shown in the drawings for ease of view. The booster cup 302 houses a booster energetic 305. For viewing ease, the booster energetic 305 is not hatched in FIG. 2A.

As shown in FIGS. 1, 2A, 2B, and 3, the embodiments employ a plurality of longitudinal vents 117. The plurality of longitudinal vents 117 are circumferentially-spaced at equal distance in the wall 118 of the hollow fuzewell 100 based on the burning rate of the main fill energetic 214. The plurality of longitudinal vents 117 are parallel to the central longitudinal axis 102, spanning longitudinally from the outer surface 116 at the flared region 112 and through the wall 118 defined by the inner 115 and outer surfaces to the distal end 105. The plurality of longitudinal vents 117 are elongated apertures that can have a cylindrical shape, a square ended annular sector, a rounded annular sector shape, ellipsoidal shape, or other shapes, including reniform, without detracting from the merits or generalities of the embodiments, Due to the fuzewell's geometry depicted in FIG. 1, the plurality of longitudinal vents 117 at the flared region 112 present a semi-elliptical shape.

Embodiments include a primary vent path for the booster energetic 305 offering additional IM benefits. The booster energetic venting features are depicted in FIG. 1 as a plurality of radial apertures 107, that can also be referred to as a plurality of radially-located apertures, radial holes, and similar terms. Each radially-located aperture 107 is an opening at the flared region 112 of the outer surface 116, and provides venting of the booster energetic 305 into an ullage space 226. Each radial aperture 107 has its proximal end at the inner surface 115 and its distal end at the flared region 112 of the outer surface 116.

The number of longitudinal vents 117 is a range of about three to about twelve vents, with the vents equally-spaced from each other. The number of radial apertures 107 is also a range of about three to twelve apertures, with the apertures equally-spaced from each other. The longitudinal vents 117 and radial apertures 107 are staggered in alternating fashion.

Figure 2B:
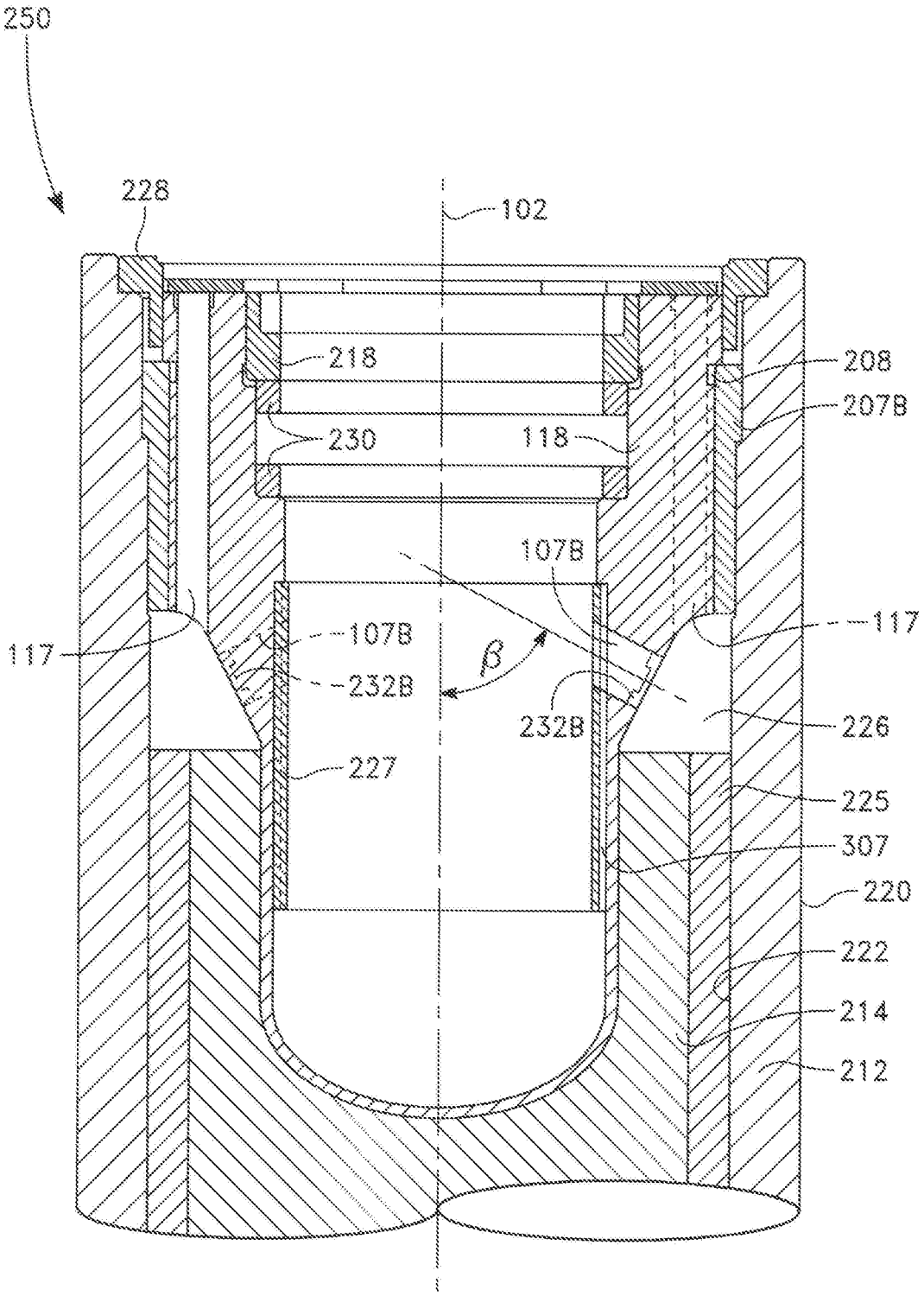
FIG. 2B is a section view of a shock mitigation mechanism including the direct impingement cook-off mechanism shown in FIG. 1 in the aft end of a generic munition.

Orientations of the radially-located apertures 107 are shown in the section views of FIGS. 2A and 2B by reference characters 107A and 107B, respectively. FIG. 2A shows the radial aperture 107A in an orthogonal orientation to the central longitudinal axis 102. Angle β in FIG. 2B depicts the 30 to 90 degrees orientation of the radial apertures 107E in FIG. 2B and specifically shows the radial aperture at less than 90 degrees from the central longitudinal axis 102. It is understood by a person having ordinary skill in the art that angle β is also present in FIG. 2A and representative of a 90 degrees angle from the central longitudinal axis 102, i.e. perpendicular to the central longitudinal axis.

A vent plug (232A & 232B in FIGS. 2A and 2B, respectively) is positioned in the distal end of each radial aperture 107, and can be referred to as vent covers and plugs. The plugs 232A/232B attach to the fuzewell 100 at the flared region 112 of the outer surface 116 with screws, threaded interfaces, and/or close fit with adhesive sealant to prevent cross contamination or debris during operational temperatures. The plugs 232A/232B melt, soften, or otherwise release at higher temperatures, i.e. during cook-off events.

In FIG. 2B, a fuzewell liner 227 is affixed to the fuzewell's inner surface 115. The fuzewell liner 227 has a plurality of longitudinal grooves 307 (shown in FIGS. 2B & 3) that are parallel to the central longitudinal axis 102. The longitudinal grooves 307 can also be referred to as longitudinal vent grooves and other similar terminology. The longitudinal grooves 307 can be an annular sector shape, a rounded annular sector shape, a reniform shape, cylindrical shape, an ellipsoidal shape transposed onto a curved axis, and other shapes. The longitudinal grooves 307 are circumferentially-spaced at equal distance from each other about the perimeter of the fuzewell liner 227 and are adjacent to the fuzewell's inner surface 115. The longitudinal grooves 307 span the length of the fuzewell liner 227 and are conduits allowing expanding gases from the fuze booster to transverse aft to and out the radial apertures 107A/107B. Spaces between the longitudinal grooves 307 are raised and are referred to as annular sectors or ribs 308. The annular sectors/ribs 308 in the fuzewell liner 227 are much smaller in width than the diameter of the radially-located apertures 107A/107B to ensure that vent paths remain tolerant of misalignment of one another to provide fuze booster venting. The fuzewell liner 227 and associated longitudinal grooves 307 also assist with shock mitigation.

A threaded release ring 207A, sometimes referred to as a release ring or releasable ring, is concentric about the fuzewell 100. The threaded release ring 207A threads onto the threaded outer surface 116 of the fuzewell 100, especially with respect to the third outer portion 108. As shown in FIG. 2A, the threaded release ring 207A is concentric about the fuzewell 100, spanning from the second outer portion 108 to the thread relief 208. As discussed later, a variation of the threaded release ring 207A used in shock mitigation embodiments is shown in FIG. 2B for a shock damping ring 207B. In the cutaway isometric view in FIG. 3, reference character 207 is generically used for a ring representing the threaded release ring 207A and/or the shock damping ring 207B.

The proximal end 103 of the fuzewell 100 is closed and semi-ellipsoidal in shape for strength in penetration. The distal end 105 of the fuzewell 100 is open. A sealing vent cover 210 is attached to the distal end 105 of the fuzewell 100. As shown in FIGS. 2A & 2B, the sealing vent cover 210 is attached at the aft end (i.e. the distal end 105) of the longitudinal vents 117. The sealing vent cover 210 has stress riser grooves (not shown for ease of view) to ensure proper opening. A munition casing 212, also referred to as munition case, is concentric about the threaded release ring 207A. The munition casing 212 is steel and has an outer surface 220 and an inner surface 222. The inner surface 222 is threaded to match threads on the releasable ring 207A. The munition casing 212 is configured to house a main fill energetic 214. The proximal end 103 of the fuzewell 100 is closed and is at least partially enveloped by the main fill energetic 214.

The inner surface 222 of the munition casing 212 is lined with an interior liner 225. The interior liner 225 can be either a protective liner or a reactive liner separating the munition casing 212 from the main fill energetic 214. Suitable protective liner materials include asphaltic hot melt, wax coating, and plastic. As depicted in FIG. 2A, the ullage space 226 is an open space/void defined by the flared region 112, the plurality of longitudinal vents 117, the releasable ring 207A, the inner surface 222 of the munition case 212, the munition case liner 225 (or reactive liner), and the main fill energetic 214.

A synthetic felt pad or foam pad is used in some munitions to provide tillage space, but it is not needed in all munitions, and is not shown in the figures for ease of view. Internally, the fuzewell inner envelope 224 is depicted as open space inside the fuzewell 100 in FIG. 2A. The fuzewell inner envelope 224 is configured to house the munition fuze 306.

The threaded release ring 207A is a glass or carbon reinforced polymer. In some embodiments, the threaded release ring 207A is about 40 percent glass fiber, with the remainder being a thermoplastic or thermosoftening plastic such as, for example, polyurethane plastic. In other embodiments, the threaded release ring 207A can be a range of about 20 percent to about 60 percent glass or carbon fiber, with a corresponding range of thermoplastic or thermosoftening plastic of about 80 percent to about 40 percent.

The sealing vent cover 210 is made of a weak polymer, such as acrylonitrile butadiene styrene (ABS), which is not reactive, can survive both hot and cold operational temperatures and does not cause foreign object damage (FOD) to aircraft. ABS will soften at very high temperatures. The sealing vent cover 210 has protrusions (not shown for ease of viewing) which locate and may protrude into the longitudinal vents 117. Channels (not shown for ease of viewing) are all-around the perimeter of the protrusions on the sealing vent cover 210 and provide a stress concentration to ensure full opening of the longitudinal vents 117. The sealing vent cover 210 is attached to the fuzewell 100 with screws which can also be configured to melt away, soften, or otherwise release at a temperature similar to the threaded release ring 207A. The screws are sometimes referred to as eutectic screws. The sealing vent cover 214) will either fly off, peel away, melt, or suffer ruptures in proximity to the longitudinal vents 117, depending on the specific cook-off event. Similarly, a vent cover retaining ring 228 is threaded and assists with sealing the fuzewell 100 to the munition case 212. The vent cover retaining ring 228 is made of a structural metal and is configured to release with the fuzewell 100 during cook-off events.

Shock Mitigation Embodiments—FIG. 2B

FIG. 2B depicts a shock mitigation device 250 in the aft end of a munition. Reference character 250 is also representative of other embodiments, including mechanisms, apparatuses, and systems in the aft end of a munition. FIG. 2A is also relied on for ease of viewing for certain structural features. Due to the symmetry of the embodiments, the cut plane for the section view in FIG. 2B is along the central longitudinal axis 102.

The fuzewell liner 227, sometimes referred to as a shock damping liner, is affixed to the perimeter of the inner surface 115 of the fuzewell 100. The fuzewell liner 227 is configured to assist with cushioning the fuze 306 by enveloping the fuze, thereby cushioning fuze electronics from transverse pyro and/or penetration shock waves. The fuzewell liner 227 is a solid material having a density greater than foams but much lower than steel, thus having a lower stiffness compared to metals, similar to conductive ultra-high molecular weight, or low density polyethylene or high density polyethylene. To ensure low static electricity or otherwise conductive properties, the fuzewell liner 227 material may include carbon. Suitable examples for the fuzewell liner 227 include a plastic-carbon mix, conductive ultra high molecular weight polyethylene, low density polyethylene mixed with carbon, high density polyethylene mixed with carbon, polyamides (nylon), and polytetrafluoroethylene (PTFE), known by the DuPont brand name Teflon®.

At least one shock damping collar 230, also referred to as a fuze shock isolation ring, or shock mitigation ring is shown. The shock isolation ring 230 is a solid material with lower density and sound speed than steel, but with sufficient strength to constrain the fuze 306 and the fuze retaining ring preload. Suitable materials include polymers (plastics) such as delrin, acetal homopolymer, ultem, nylon. As shown in FIG. 3, the shock damping collar/shock isolation ring 230 is two collars. The fuze 306 has a flange 310 that protrudes and is sandwiched between the two collars of the shock isolation ring 230.

In FIG. 2B, the fuze shock isolation ring 230 is depicted as two collars that are configured to sandwich a locating feature (not shown in FIG. 2B) of the fuze 306 and are retained by a steel fuze retaining ring 218, which is sometimes referred to as a fuze retaining ring 218. The fuze retaining ring 218 is attached about the perimeter of the third inner portion 223 of the inner surface 115 and securely retains the shock isolation ring 230 and the fuze 306 in place within the fuzewell inner envelope 224. The shock isolation ring 230 acts on the fuze 306 by providing an impedance mismatch as well as damping the shock incurred during penetration or a pyroshock event, thus significantly attenuating the shock experienced by the munition fuze 306. The fuzewell inner envelope 224 can also have a step 217, or transition, from the second inner portion 221 to the third inner portion 223.

For a pyroshock mitigation system in the aft end of a munition, as depicted in FIG. 2B, a shock damping ring 207B is concentric about the hollow fuzewell 100. The shock damping ring 207B is a glass or carbon reinforced polymer. In some embodiments, the shock damping ring 20'7B is about 40 percent glass or carbon fiber, with the remainder being polyurethane plastic or other suitable binder/matrix material. In other embodiments, the shock damping ring 207B can be a range of about 20 percent to about 60 percent carbon fiber, fiber glass, or aramid reinforcement, with a corresponding polymer binder range of about 80 percent to about 40 percent.

The shock damping ring 207B is threaded and threads onto the threaded outer surface 116 of the fuzewell 100, especially with respect to the second outer portion 108. As shown in FIG. 2B, the shock damping ring 207B is concentric about the fuzewell 100, spanning from the second outer portion 108 to a thread relief 208.

Theory of Operation

The threaded release ring 207A is threaded onto the fuzewell 100 and torqued to specification. Following this, the assembly of the releasable ring 207A and the fuzewell 100 are inserted into the inner surface 222 of the munition casing 212 and torqued to specification. The sealing vent cover 210 is then attached to the fuzewell 100 with adhesive or screws. If the stress concentrations or additional mechanisms are not included that ensure release, then the screws or adhesive are configured to melt away, soften, or otherwise release at temperature similar to the threaded release ring 207A.

The threaded release ring 207A melts or thermally softens such that its strength is removed. The fuzewell 100 features longitudinal vents 117 and radial apertures 107, through which the hot expanding gases from the main-fill energetic 214 and booster energetic 305 traverse, respectively. The radial apertures 107 redirect flow of the booster gases to impinge upon the free surface of the main-fill energetic 214 to initiate burning. The longitudinal vents 117 permit the expanding gases to then vacate the munition.

The embodiments optimize ignition. The booster energetic 305 is encapsulated and sealed within the thermally softening/releasing or otherwise disintegrating booster cup 302. The booster energetic 305 has a lower self-heating temperature, also known as a lower auto-ignition temperature, such that it ignites during an undesired thermal stimulus before the main fill 214 reacts. The booster energetic 305 quantity is small compared to the main fill energetic 214. During cook-off, the booster energetic 305 decomposes, making expanding hot gases that vent through the holes 303 into the fuzewell 100 and around the fuze 306.

The radially-located apertures 107 are configured to assist in transporting and directing the gases to impinge on the free surface of the main fill energetic 214. The decomposing booster energetic 305 ignites the main fill energetic 214 to burn, producing more expanding gases. The confluence of expanding gases exert opposing pressure acting to separate the fuzewell 100 from the rest of the munition. The radially-located apertures 107 are angled from about 30 degrees to about 90 degrees from the central longitudinal axis 102 and are oriented to vent the expanding internal gases inside the fuzewell 100 out to the tillage space 226 onto the exposed surface of the main fill energetic and then, ultimately out the longitudinal vents 117. The expanding gases from the main fill energetic 214 also vent through the longitudinal vents 117, which prevents excessive pressure build up.

The booster housing 301 and, specifically, its holes 303, can be sealed with a thin layer such as a burst disk. The booster housing 301 with holes 303 (also known as a booster assembly) is installed within the fuzewell 100 with the radial apertures 107 internal to the munition to transport expanding gases from the booster energetic 305 to the desired location.

The booster energetic 305 is an explosive and is chosen such that it has a lower self-heating temperature than the main fill energetic 214, while also providing the necessary elevation in output energy necessary to detonate or otherwise initiate the munition in design mode. The booster energetic 305 is a different explosive than the main fill energetic 214, and is conventionally already included in munitions in order to elevate energy output of fuzing to initiate the munition in design mode. Although, the booster energetic 305 can be a main fill-type of energetic. The radial apertures 107 working with longitudinal grooves 307 enable the booster energetic 305 to provide a dual purpose in relation to cook-off mitigation which allows less parasitic mass and volume compared to current configurations.

The fuzewell liner 227 holds the fuze 306 concentric within the fuzewell to ensure uniformly distributed longitudinal grooves 307 interface evenly with the radial apertures 107. The desired location of the radial apertures 107 is typically near the free surface of the main fill energetic 214 in close proximity to the longitudinal vents 117 for venting exterior to the munition. The longitudinal vents 117 allow for more effective and complete drainage of the reactive liner 225 and the threaded release ring 207A.

The embodiments redirect the expanding gases produced by ignited energetics to enlarge vent paths (the longitudinal vents 117 and radial apertures 107) through erosion, enabling improved munition response to the SCO and FCO insensitive munitions tests. Increased erosion enables use of smaller vent paths than typically required, to enable use of stronger parts to satisfy penetration survivability and other operational requirements.

The reduced interface due to the longitudinal vents 117 are constructed to further reduce shock energy transmitted to the fuze 306 due to, but not limited to, loads during penetration and pyro-shock. As such, embodiments offer many positive aspects, including: shock damping, vent paths to prevent pressure build-up and violent release, maintaining penetration survivability/joint strength, multi-purpose booster material to start mild burning at vent location to preempt energetic run-away, and use of venting hot gases to enlarge vent holes as well as assist in release of fuzewell 100. Embodiments accomplish this without the negative aspects of: pent-up pressure release in violent events, compromised joint strength to enable fuzewell 100 release, permanent joints preventing disassembly for maintenance or assessment, single point of failure vent paths, parasitic mass or volume, and energetic main fill auto-ignition at undesired location.

The shock damping ring 207B has a lower stiffness and density and thus more damping properties than typical metal parts. This results in an impedance mismatch across the interfaces. This additional damping, as well as impedance mismatch, results in reduced shock and vibrational pressures and stresses transferred to the fuze. Thus, the energy experienced by the shock damping ring 207B, especially the portion adjacent to the longitudinal vents 117 and grooves 307, is not transferred to the fuzewell 100 or fuze 306. The longitudinal vents 117 reduce the interface area across which shocks can be transmitted, further reducing the shock transmitted to the fuze 306.

While the embodiments have been described, disclosed, illustrated and shown in various terms of certain embodiments or modifications which it has presumed in practice, the scope of the embodiments is not intended to be, nor should it be deemed to be, limited thereby and such other modifications or embodiments as may be suggested by the teachings herein are particularly reserved especially as they fall within the breadth and scope of the claims here appended.

What is claimed is:

1. A direct impingement cook-off mechanism, comprising:

a hollow fuzewell having a proximal end, a distal end, an inner surface, an outer surface, and a wall defined by said inner surface and said outer surface, said hollow fuzewell centered about a central longitudinal axis, said inner surface defining a fuzewell inner envelope having a first inner portion, a second inner portion, and a third inner portion, wherein said first inner portion is located at said proximal end, said third inner portion is located at said distal end, wherein said second inner portion separating said first and third inner portions;

wherein said outer surface having a first outer portion and a second outer portion, said first outer portion corresponding to said proximal end, said second outer portion corresponding to said distal end, said first and second outer portions separated by a flared region;

a fuzewell liner affixed to said second inner portion, said fuzewell liner having a plurality of longitudinal grooves parallel to said central longitudinal axis;

a booster housing inside said hollow fuzewell at said proximal end, wherein said booster housing is concentric about a thermally-softening booster cup;

a booster energetic housed in said thermally-softening booster cup; and a plurality of longitudinal vents circumferentially-spaced at equal distance in said wall, said plurality of longitudinal vents spanning longitudinally, parallel to said central longitudinal axis, from said outer surface at said flared region and through said wall to said distal end.

2. The mechanism according to claim 1, wherein said outer surface is threaded along said second outer portion.

3. The mechanism according to claim 1, further comprising an air gap conduit adjacent to said inner surface at said proximal end, wherein said air gap conduit is concentric about said booster housing and separates said booster housing from said inner surface.

4. The mechanism according to claim 1, wherein said first outer portion having a first diameter, said second outer portion having a second diameter, wherein said first diameter is less than said second diameter.

5. The mechanism according to claim 1, wherein said thermally-softening booster cup is a polymer.

6. The mechanism according to claim 1, wherein said booster housing having a plurality of circumferentially-spaced holes.

7. The mechanism according to claim 1, further comprising a plurality of radial apertures, each radial aperture in said plurality of radial apertures having a proximal end at said inner surface and a distal end at said flared region of said outer surface.

8. The mechanism according to claim 7, further comprising a vent plug in said distal end of each radial aperture in said plurality of radial apertures.

* * * * *